US006792707B1

(12) United States Patent
Setteducati

(10) Patent No.: US 6,792,707 B1
(45) Date of Patent: Sep. 21, 2004

(54) PERSONALIZED ANIMATION BY SELECTIVE REFLECTION

(76) Inventor: Mark Setteducati, 218 E. 17 St., New York City, NY (US) 10003

( * ) Notice: Subject to any disclaimer, the term of this patent is extended or adjusted under 35 U.S.C. 154(b) by 161 days.

(21) Appl. No.: 09/808,552

(22) Filed: Mar. 14, 2001

Related U.S. Application Data

(60) Provisional application No. 60/189,583, filed on Mar. 15, 2000.

(51) Int. Cl.[7] ..... G09F 19/14

(52) U.S. Cl. ..... 40/453; 40/725; 40/900; 40/219; 359/831; 359/834

(58) Field of Search ..... 40/453, 725, 737, 40/743, 900, 219; 359/831, 833, 834, 836; 283/117

(56) References Cited

U.S. PATENT DOCUMENTS

| | | | | | |
|---|---|---|---|---|---|
| 1,473,939 | A | * | 11/1923 | Russell | 40/453 |
| 2,690,624 | A | * | 10/1954 | Phillips | 40/652 |
| 2,832,593 | A | | 4/1958 | Anderson | |
| 3,119,195 | A | | 1/1964 | Braunhut | |
| 3,628,238 | A | | 6/1964 | Finker | |
| 3,364,603 | A | * | 1/1968 | Tate, Jr. | 40/642.02 |
| 3,561,146 | A | * | 2/1971 | Dembar | 40/720 |
| 3,586,592 | A | | 6/1971 | Cahn | |
| 3,760,521 | A | * | 9/1973 | Barraya | 40/720 |
| 4,268,985 | A | * | 5/1981 | Lecznar | 40/219 |
| 4,593,876 | A | | 6/1986 | Greiner | |
| 4,898,560 | A | * | 2/1990 | Moscovich | 446/85 |
| 5,358,282 | A | | 10/1994 | Giambruno et al. | |
| 6,133,892 | A | * | 10/2000 | Borgwardt | 345/1.3 |

FOREIGN PATENT DOCUMENTS

DE 2 252 743 * 5/1974

* cited by examiner

*Primary Examiner*—William L. Miller
(74) *Attorney, Agent, or Firm*—Robert W J Usher

(57) ABSTRACT

First and second half or associated objects, in respective different sequential positions are aligned behind respective adjacent, first and second, inclined faces of an optical prism so that, when viewed at different angles alternately through a front face of the prism, images of the first and second half objects are seen alternately by transmission and total internal reflection at alternate faces, combining to form completed whole images of first and second objects alternatively, thereby providing an impression of animation by object movement. The half objects can be pictures of half of a same or similar face or person having respective different expressions producing a changing expression or hands producing a clapping effect. Written message portions associated with half objects can form a complete message/slogan when viewed at alternate angles. The optical prism can be solid or liquid filled and embodied in picture frames, domestic utensils or personal accessories/apparel.

11 Claims, 9 Drawing Sheets

PERSONALIZED ANIMATION BY SELECTIVE REFLECTION

RELATED APPLICATION

Provisional application No. 60/18953, filed Mar. 15, 2000, from which priority is claimed.

FIELD OF THE INVENTION

The invention concerns the production of a personalized animated effect by selected reflections of related objects in sequential positions from respective different faces of a prism or other mutually inclined reflective surfaces. More, particularly, the invention concerns the provision of an amusing animation of a personal photo.

BACKGROUND OF THE INVENTION

It is known to provide animated or motion picture effects by overlaying a lenticular screen formed by a large number of minute lenticules on pictures or displays composed of a large numbers of alternately different image elements selectively visible through the lenticular screen when viewed at different angles. Examples of such prior art are disclosed in U.S. Pat. No. 3,268,239 issued 1966 to Finkel; U.S. Pat. No. 2,832,593 issued 1964; and U.S. Pat. No. 3,119,195 issued to Braunhut. Another display for obtaining a changeable picture by multiple reflections is taught in U.S. Pat. No. 3, 586,592 issued 1968 to Cahn.

However, these particular forms of displays, (sometimes known as parallax panoramograms), and referred to in the Finkel patent as "animation displays" can be relatively difficult and time consuming to make.

U.S. Pat. No. 4,593,876 issued 1986 to Greiner teaches a picture stand employing a frame and two prims to display four different pictures of which only two are visible at a time depending on the angle of view.

SUMMARY OF THE INVENTION

It is an object of the invention to provide an amusing personalized animated effect by selected reflections of the same or related objects in sequential positions from respective different faces of a single prism.

More specifically, first and second half objects (or first and second related objects), in respective different sequential positions are aligned behind respective adjacent, first and second, inclined faces of an optical prism so that, when viewed at different angles alternately through a front face of the prism, images of the first and second half objects, (or of the first and second related objects), are seen alternatively by transmission and total internal reflection at alternate faces so that they combine to form completed whole images of the first and second objects alternatively, thereby providing an impression to the viewer of animation by object movement.

In other words, when viewed through the front face at a first angle, an image of the first half object aligned behind the first face will be seen by direct transmission through the first rear and front faces and will combine with a mirror image of the first half object seen by transmission through the first face, total internal reflection at the second face and, transmission through the front face to provide a composite image apparently of the whole first object and, when viewed through the front face at a second angle, an image of the second half object aligned behind the second face will be seen by direct transmission through the rear and front faces and will combine with a mirror image of the second half object seen by transmission through the rear face, total internal reflection at the first face and transmission through the front face to provide a composite image apparently of the whole second object.

The first and second half objects may, respectively, be pictures of half of a same or similar face or person having respective different expressions producing a changing expression or hands producing a clapping effect. Written message portions may be associated with respective half objects to form or complete a slogan or message when viewed at alternate angles. The optical prism may be constituted by any suitable refractive material such as glass, plastic or a container of liquid such as water.

As a result of the relative simplicity of construction, the principle of the invention may be readily embodied in many commonly used articles such as picture frames, domestic utensils or personal accessories/apparel. Forming the pictures from personal photographs personalization of a variety of commonly used articles.

The invention also provides A kit for making an amusement device providing an animated display of a person's photo comprising:

means for providing an optical prism having a front, optical face and first and second, inclined rear faces;

a first picture of a first half of a character's body in a first position and a second picture, of a complementary half of the character's body in a second position, sequentially different from the first position;

the first picture and the second picture defining adjacent areas on the respective characters body halves for mounting a photo of a person's face;

means for holding the optical prism with said first picture and a first half of said photo mounted thereon showing a first half of the person's face aligned behind said first rear face and with said second picture mounting a second half of said photo mounted thereon showing a second half of the person's face aligned behind said second rear face, so that, when viewed through the front face at a first angle, a image of the first picture and first half of the person's face will be seen by direct transmission through the first rear face and the front face and a mirror image of the first picture and first half of the person's face will be seen by direct transmission through the first rear face, total internal reflection at the second rear face and subsequent transmission through the front face so that the direct and mirror images combine to provide a completed image, apparently of the character's whole body in the first position with apparently the person's whole face thereon and, when viewed through the front face at a second angle, an image of the second picture and second half of the person's face will be seen by direct transmission through the second rear face and front face and a mirror image of the second picture and second half of the person's face will be seen by transmission through the second rear face, total internal reflection at the first rear face and subsequent transmission through the front face so that the direct and mirror images combine to provide a completed image apparently of the character's whole body in the second position with apparently the person's whole face thereon, whereby a spectator looking through a front face of the prism and rapidly switching between different angles sees apparently whole images of the character's body mounted with the persons face in the first position and in the second position alternatively, thereby providing an amusing impression of personalized animation.

The first picture and the second picture can be on a single sheet adjoining a central vertical axis dividing the sheet into left and right halves, respectively, and formed with a fold line for folding the sheet about the central vertical axis for location with left and right halves aligned, respectively, behind adjacent rear faces of the prism so that the central vertical axis is aligned with the intersection of the first and second rear faces of the prism. The holding means may comprise a picture frame surrounding the front face of the prism and having means for securing the first and second pictures in alignment with the respective rear faces of the prism. The means for providing the optical prism may comprise a clear walled prismatic shaped container for holding water.

The first and said second photos respectively may comprise a whole face or complementary half faces having respectively different expressions or any picture of any face cut from a personal photo or magazine picture of a famous personality. In either case, the size of the whole face need not match precisely the size of the background body on which it is mounted. In fact, a very small head on a big body or a big head on a small body can be extremely amusing. This facilitates use and marketability of the kit as there is no need for the user to search for a picture of a precisely matching size.

The character body may be human, animal or robotic possibly well known in the entertainment field, cartoon or real life personalities.

BRIEF DESCRIPTION OF THE DRAWINGS

Embodiments of the invention are shown by way of example only in the accompanying drawings in which.

PARTICULAR DESCRIPTION

Figure 1B:
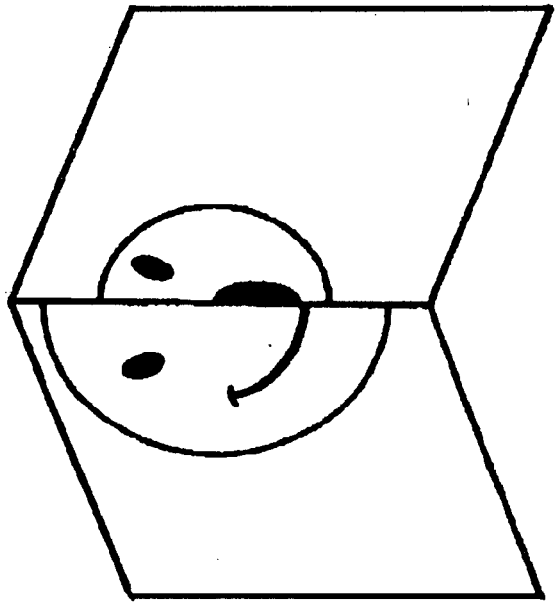
FIGS. 1*a* and 1*b* are schematic front views of a card gimmick, before and after folding, respectively.
Figure 1A:
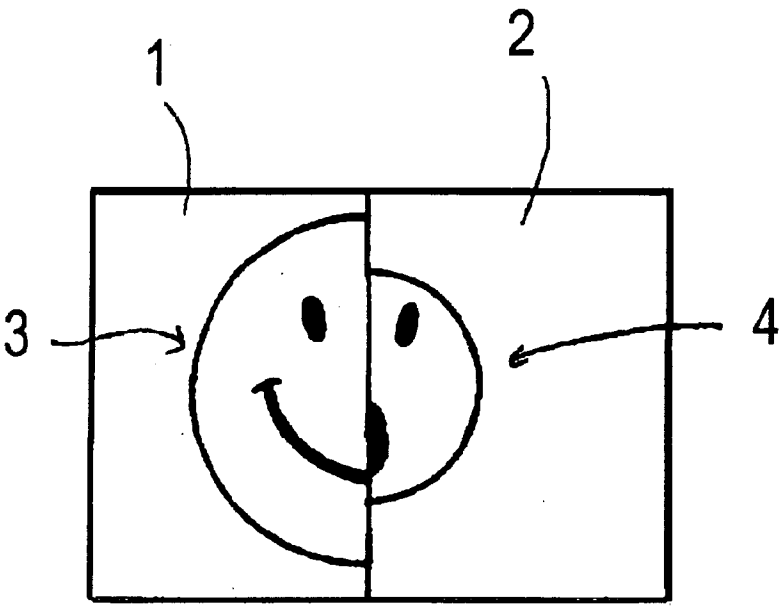

FIGS. 1*a* and 1*b* show a gimmick comprising a card having left half and right halves 1 and 2, respectively, the left half 1 carrying a picture of first half object 3 representing a half of a large face having a smiling expression and the right half 2 carrying a picture of a second half object 4 constituted by half of a smaller face having an astonished or horrified expression. Both half objects have their respective axes of symmetry aligned with the central vertical axis dividing the card into the left and right halves. The card is folded about the central vertical axis as shown in FIG. 1*b* and placed with left and right halves aligned, respectively, behind adjacent faces 6 and 7 so that the central vertical axis is aligned with the intersection of the first and second faces of the prism.

Figure 2A:
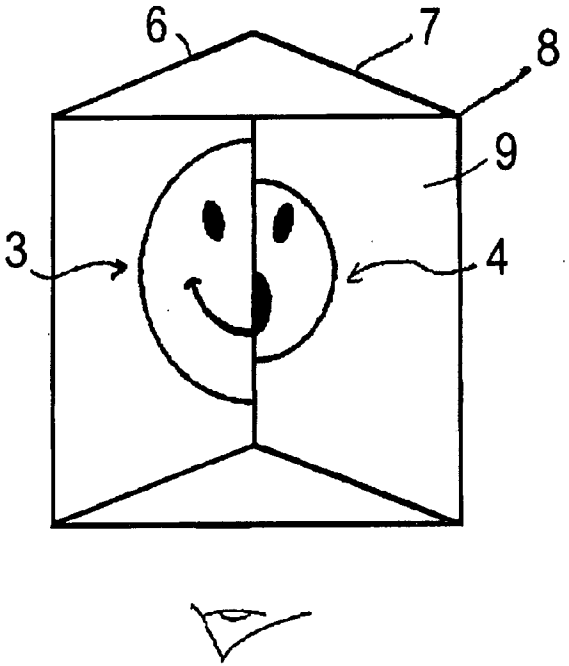
FIGS. 2*a*, 2*b* and 2*c* are diagrammatic front perspective views of a stationary optical prism behind which the folded card of FIG. 1*b* is mounted showing the different composite images seen when the card is viewed through the front face of the prism from respectively different angles.
Figure 2B:
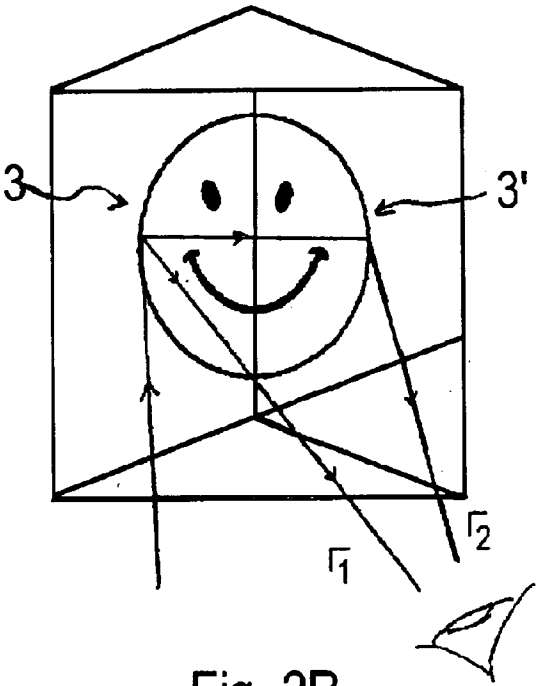

As shown in FIG. 2*a*, when viewed perpendicularly through the front face of the prism 8, images of both half objects 3 and 4 will be seen by direct transmission through rear and front faces.

When viewed from the right side of the front face of the prism, the first half object 3 behind prism face 6 is seen through the front face by direct transmission (through rear and front faces) and a mirror image 3' seen by transmission through the rear face, total internal reflection from adjacent face 7, and transmission through the front face, the images combining form a composite image apparently of a whole smiling face. The typical paths of the direct and reflected light are shown schematically by r1 and r2, ignoring refractive effects at the front face of the prism.

Figure 2C:
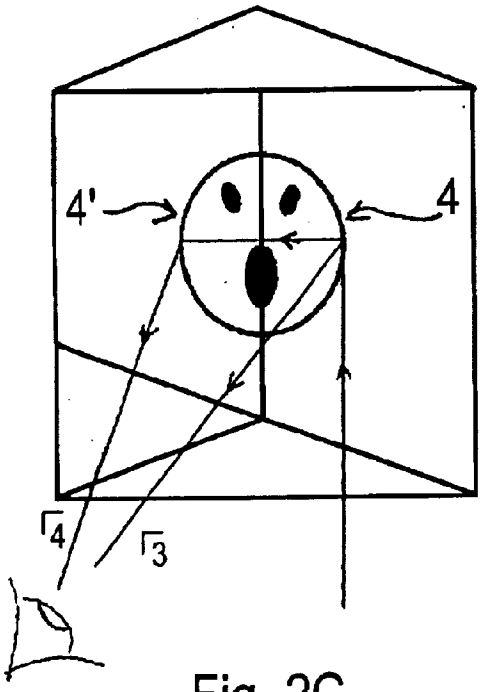

Alternatively, when viewed from the left side of the front face of the prism, an image of the second half object 4 behind prism face 7 is seen through the front face of the prism by direct transmission (through rear and front faces) and a mirror image 4' seen by transmission through the rear face, total internal reflection from adjacent face 6, and transmission through the front face, the images combining to form a composite image apparently of a whole horrified face, as shown in FIG. 2*c*.

The paths of the direct and reflected light are shown schematically by r3 and r4, ignoring refractive effects at the front face.

Thus, when the angles of viewed are alternated rapidly an impression of animation is obtained exagerated by the change in the size of the faces.

Figure 3C:
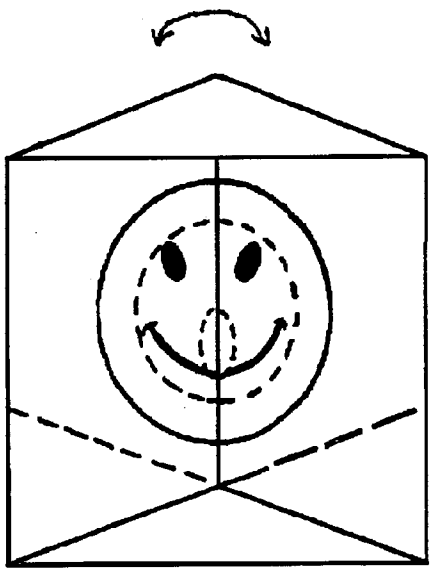
FIG. 3*c* is a diagrammatic front perspective view of the optical prism of FIG. 2*a* showing the impression of animation when the prism is rocked between the different angles.
Figure 3B:
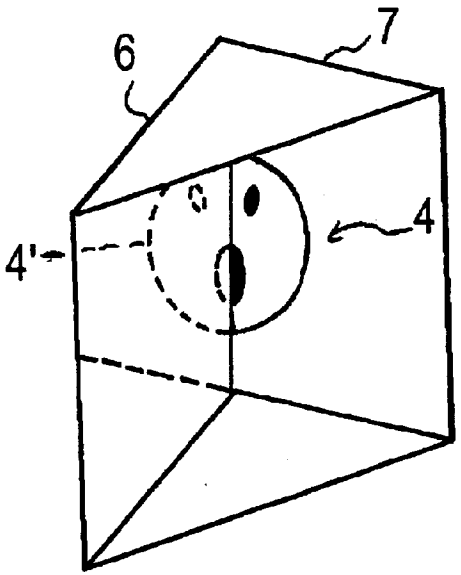
FIGS. 3*a* and 3*b* are diagrammatic front perspective views of the optical prism of FIG. 2*a* showing the different card images obtained when the prism is set at respectively different angles.
Figure 3A:
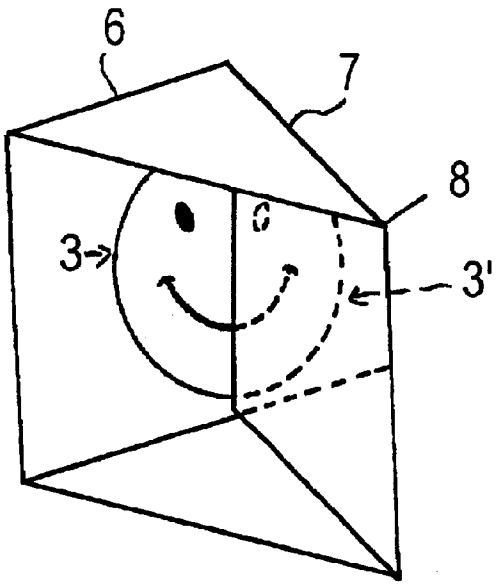

As shown in FIGS. 3*a* and 3*b*, the alternative composite images can be obtained by changing the angular position of the prism and FIG. 3*c* is a schematic simulating the impression of animation obtained by rocking the prism between the two angular positions.

Figure 4A:
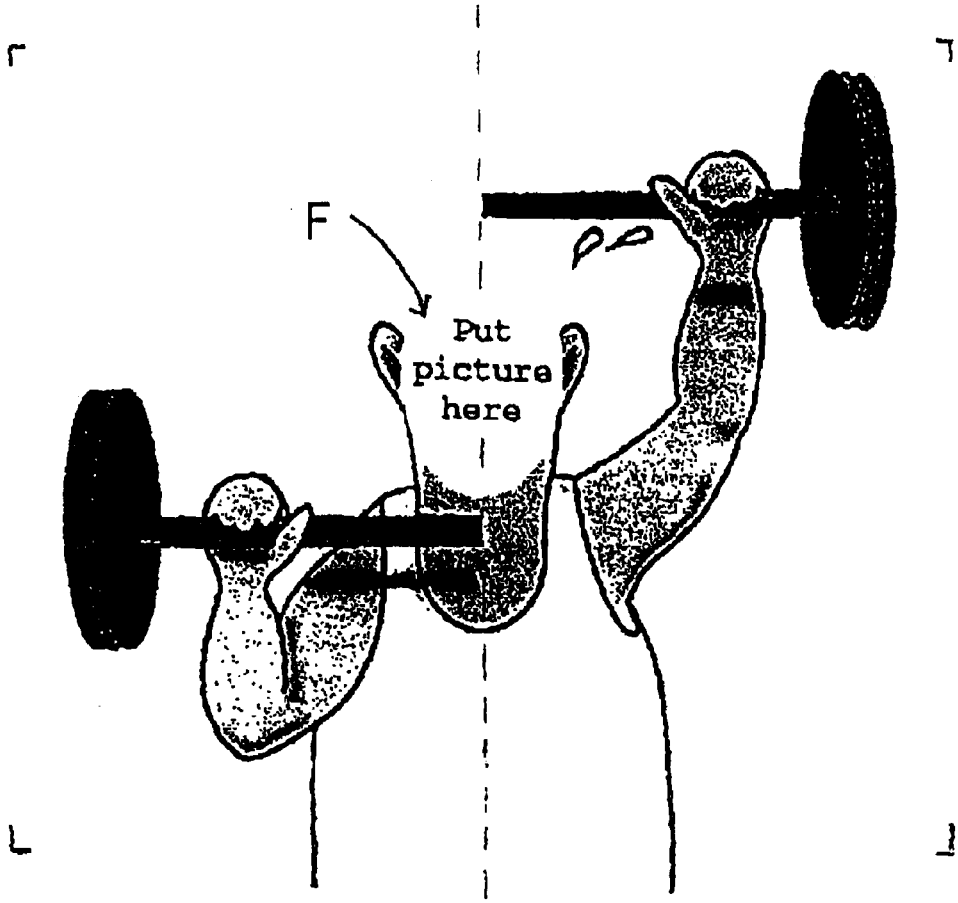
FIGS. 4*a*, 4*b* and 4*c* are schematic front views of alternative card gimmicks of a weight lifter, human face and human figure with respective first and second half objects in sequential positions of movement.

As shown in FIG. 4*a*, a background picture shows complementary halves of a character weight lifter's body joined/divided at a central vertical axis with a location F specified for mounting a photo of a person's face, providing amusing weight lifting animation when mounted and viewed through the prism at different angles.

Figure 4B:
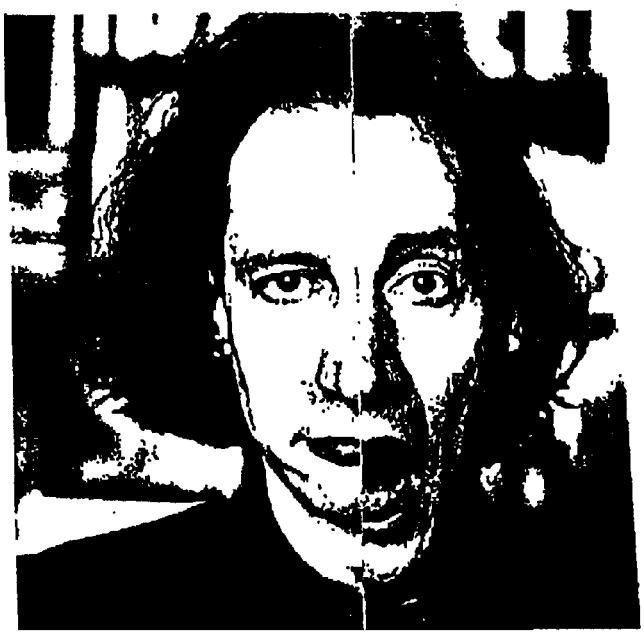
Figure 4C:
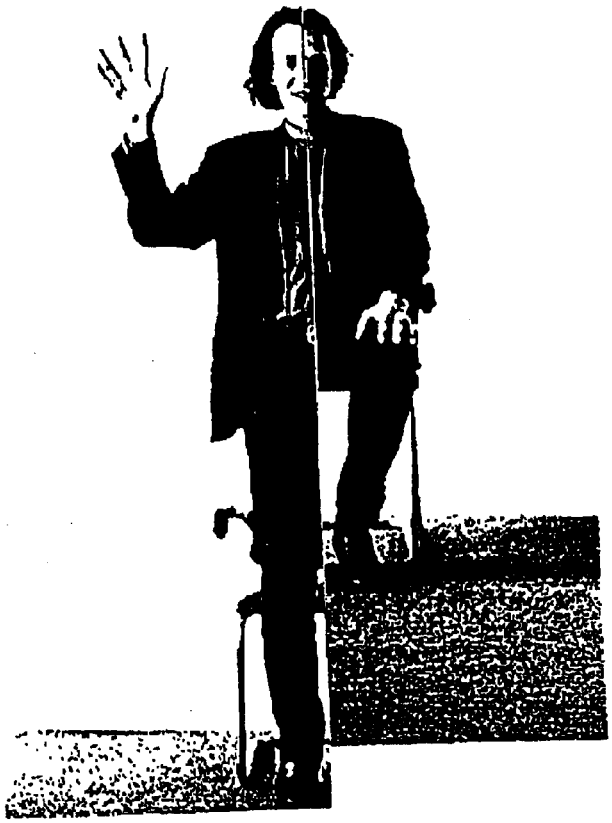

FIGS. 4*b* and 4*c* show, respectively, complementary halves of a human face and human figure, the complementary halves of each pair being in different sequential positions of movement, to provide, when suitably mounted and viewed through the prism at different angles amusing animation showing changing facial expression and movement between a standing position with both arms raised and a sitting position with both arms raised lowered.

Figure 5:
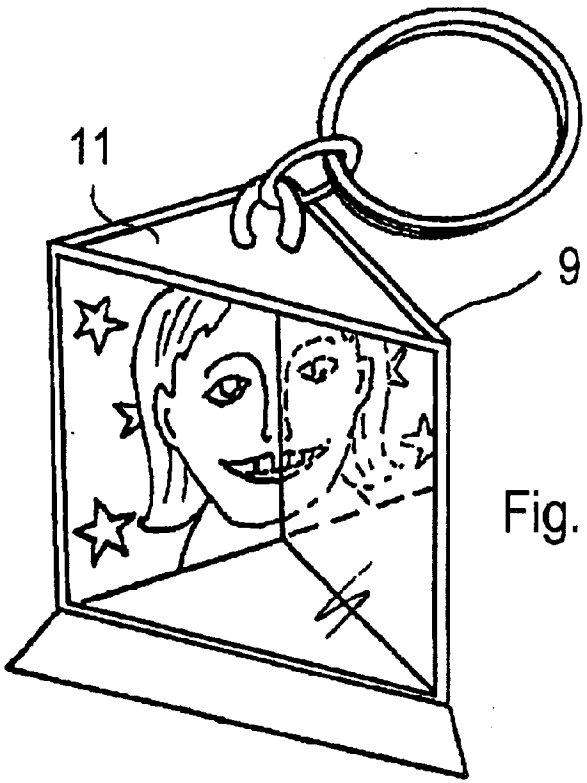
FIG. 5 is a perspective view of a key-chain frame containing a prism carrying photographs showing two different expressions of (half) a face.

As shown in FIG. 5, a key-chain frame 9 holds a glass or plastic prism 11 carrying photographs showing two different expressions of (half) a persons face, for example. The respective photographs may be inserted between a rear portion of the frame backing the rear faces of the prism or adhered to the rear faces of the prism.

Figure 6A:
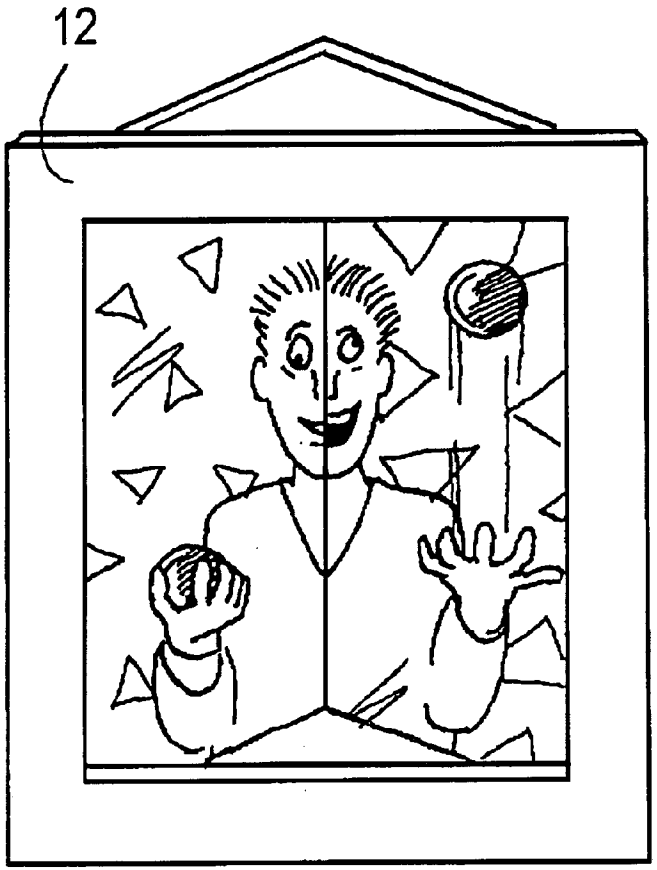
FIGS. 6 is a perspective view of a picture frame with a prism carrying two different action shots of the same subject.

The picture frame 12, shown in FIG. 6*a*, carries two different action shots of the same subject. The frame may be provided with a backing plate enabling the folded picture sheet to be inserted and trapped between the backing plate and the rear adjacent faces of the prism. For economy, the prism may be a prismatic container of clear plastic or glass for filling with water by the purchaser. As shown in FIG. 4, a an area/location may be provided on each picture half to which the picture of a half of a known person face may be attached for a novelty effect. The face size need not match the body size eaxacly and a noticably smaller or larger face may enhance the amusing effect.

Figure 7:
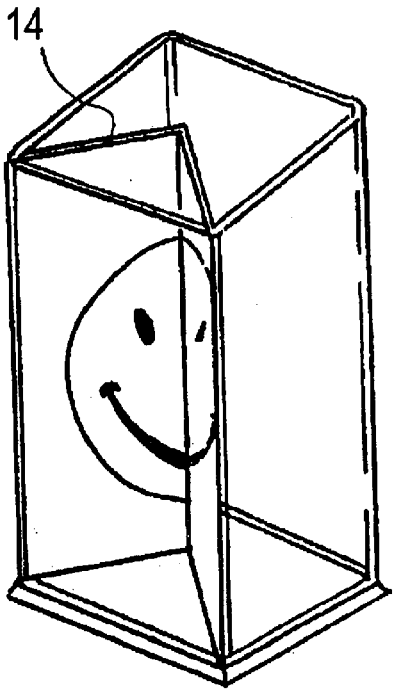
FIG. 7 is a perspective view of a clear cotton jar or other container with a solid prism shaped container for water at a front, adjacent rear faces of which are respectively marked with half faces with respectively different expressions.

A cotton jar or other container shown in FIG. 7 has a prism shaped container 14 for water at a front, adjacent rear faces of which are marked with half faces with different expressions.

Figure 8:
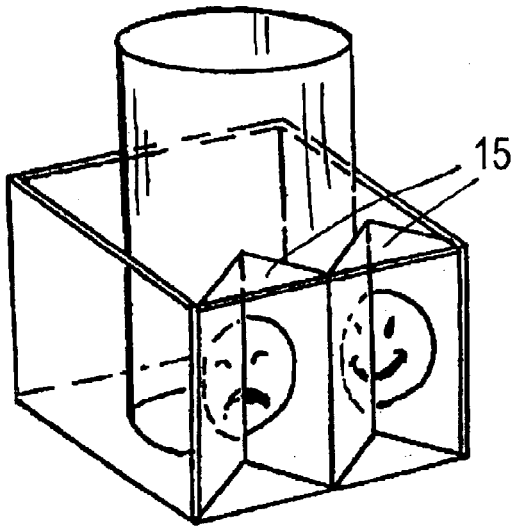
FIG. 8 is a perspective view of a drinking glass holder having two optical prisms at a front face with respective adjacent rear faces each carrying half faces with different expressions.

A drinking glass holder shown in FIG. 8, has two prisms or prismatic containers 15 for liquid in side by side relation at a front face, respective adjacent rear faces of respective prisms are each marked with half faces with different expressions.

Figure 9:
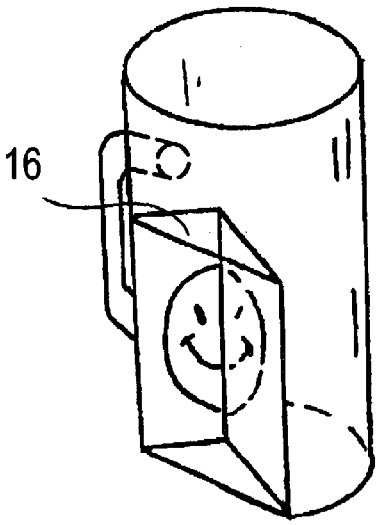
FIG. 9 is a perspective view of a drinking mug containing a prism with a front, viewing face outermost and rear adjacent faces marked with half faces with different expressions.

A mug, shown in FIG. 9, contains a solid or liquid receiving prismatic liquid receiving compartment 16 having rear adjacent faces marked with half faces with different expressions and a front face formed by a clear front wall of the mug.

Figure 10:
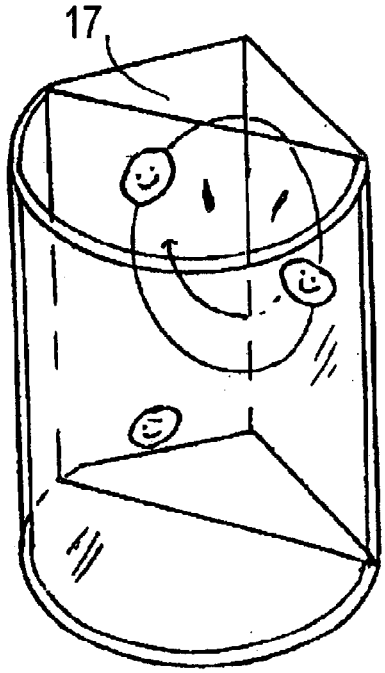
FIG. 10 is a perspective view of a drinking glass having one wall portion formed by a prism with half faces with different expressions marked on outermost adjacent rear walls of the prism for viewing through a front face behind a beverage contained liquid.

A drinking glass, shown in FIG. 10, has one wall portion formed by a prism 17 with half faces with different expressions marked on adjacent rear walls of the prism. Small smiling faces are also marked on the front, major face of the prism. The prism is located for viewing of the alternating images through contents of the glass.

Figure 11A:
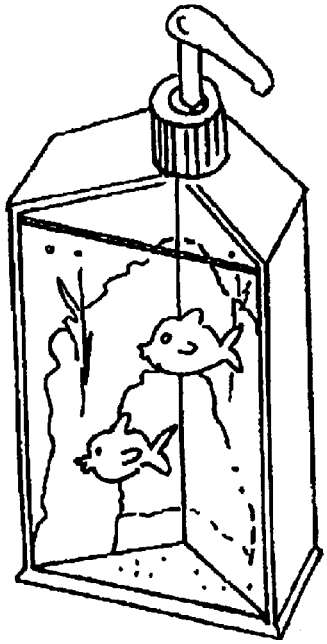
FIG. 11*a* is a perspective view of a soap/lotion dispenser incorporating a liquid optical prism with different background illustrations on rear adjacent faces.

A soap/lotion dispenser, shown in FIG. 11, incorporates a liquid prism with different background illustrations on rear adjacent faces and solid plastic fish floating inside the liquid prism. The soap/lotion is stored behind the prism.

Figure 11B:
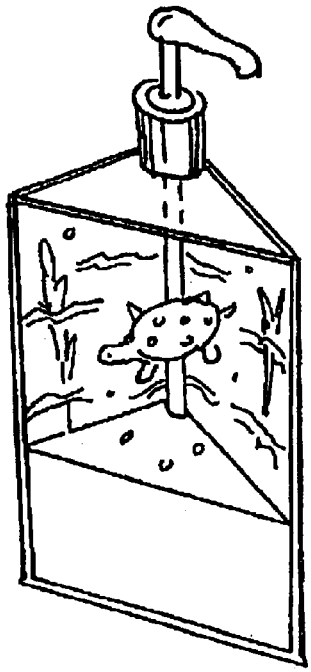
FIG. 11*b* is a perspective view of another embodiment of soap/lotion dispenser incorporating a liquid optical prism with different background illustrations on rear faces.

FIG. 11*b* shows a soap/lotion dispenser incorporating a liquid prism with different background illustrations on rear adjacent faces and solid plastic animal fish floating inside the liquid prism. The soap/lotion is stored below the prism.

Figure 12:
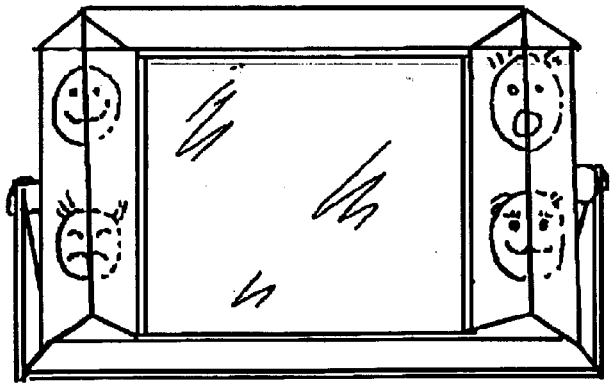
FIG. 12 is a perspective view of a mirror with tall prisms mounted at opposite ends with half faces having respective adjacent rear faces marked with half faces with different expressions.

FIG. 12 shows a mirror with stand with opposite ends of a frame carrying tall prisms with half faces having different expressions marked on adjacent rear faces of the prisms.

Figure 13:
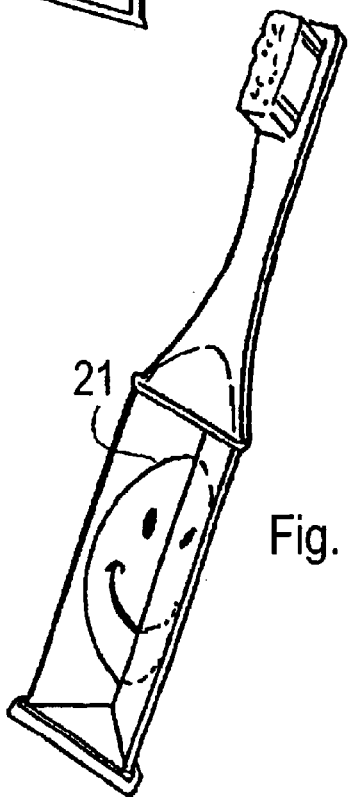
FIG. 13 is a perspective view of a toothbrush with handle formed by an optical prism with adjacent rear faces marked with half faces having different expressions.

The toothbrush shown in FIG. 13 has an optical prism 21 forming a handle. Adjacent rear faces of the prism are marked with half faces having different expressions. The brushing motion produces the rapid changes of viewing angle for an impression of animation.

Figure 14:
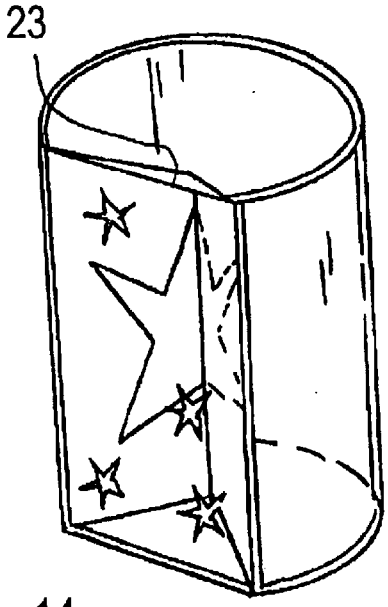
FIG. 14 is a perspective view of another drinking glass integrally formed with a solid prism positioned with the major face outward.

FIG. 14 shows a drinking glass integrally formed with a solid prism 22 positioned with the major face outward. Illustrations of half stars of different sizes are marked on the rear adjacent faces. An upper side face 23 of the prism is inclined downward as it extends inward to avoid interference with drinking.

Figure 15:
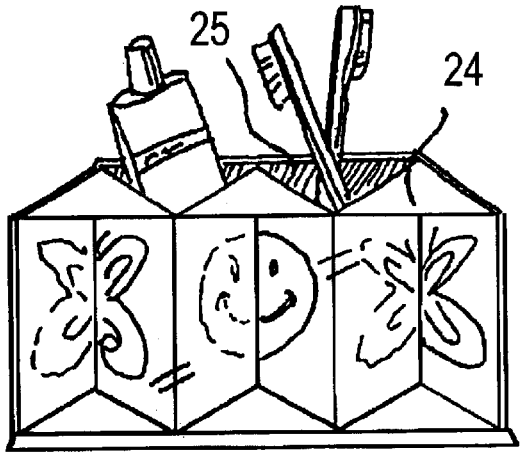
FIG. 15 is a perspective view of a toothbrush holder having a front face formed by front major surfaces of three solid optical prisms.

FIG. 15 shows a toothbrush holder having a front face formed by front major surfaces of three solid optical prism portions 24 molded as one piece, machined in one piece from a single block or made separately and fixed together in side by side relation so that interstices 25 between adjacent rear faces cooperate with a back wall to define separate, adjacent toothpaste and toothbrush receiving compartments. Illustrations of half faces with different expressions and half butterflies with wings in different positions are marked on or aligned behind adjacent rear faces of respective prisms.

Figure 16:
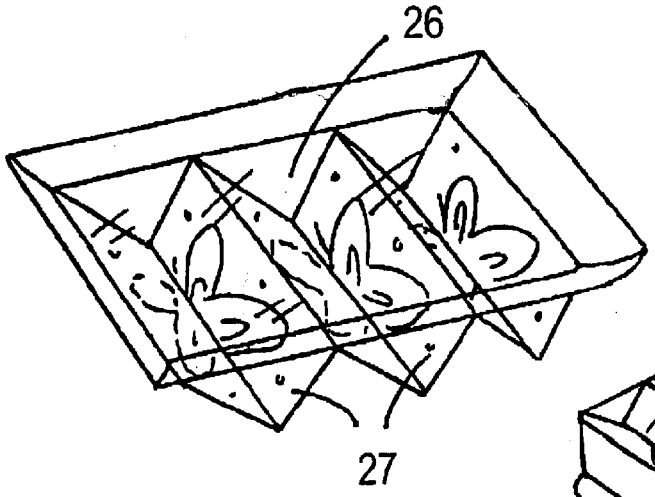
FIG. 16 is a perspective view of a soap dish having an upper, soap supporting face formed by front major surfaces of three solid optical prisms.

A soap dish shown in FIG. 16 has an upper, soap supporting face 26 formed by coplanar, contiguous front major surfaces of three solid optical prisms portions 27 molded as one piece, machined in one piece from a single block or made separately and fixed together in side by side relation. Illustrations of half butterflies with wings in different positions are marked on or aligned behind adjacent rear faces of respective prisms.

Figure 17:
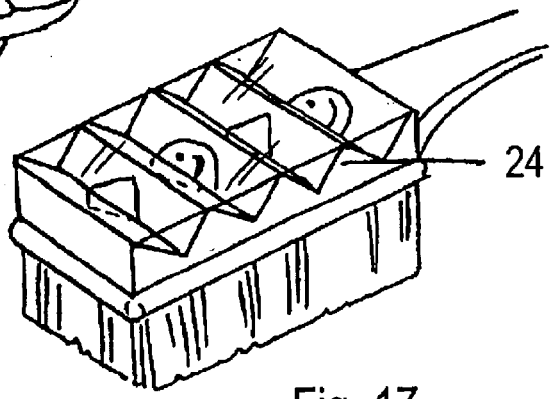
FIG. 17 is a perspective view of an (upper), back of a bristle carrying head of a scrub brush formed by front major surfaces of five solid optical prisms.

A scrub brush, shown in FIG. 17 scrub brush has an (upper), back of a bristle carrying portion face formed by coplanar, contiguous, front major surfaces of five solid optical prisms 29 molded as one piece, cut in one piece from a single block or made separately and fixed together in side by side relation. Illustrations of half faces or shapes in different positions are marked on or aligned behind adjacent rear faces of respective prisms so that viewing from selected different angles alternately provides an animated effect similar to all the prior examples.

All of the examples disclosed above can be made from transparent/clear plastic or glass.

What is claimed is:

1. An amusement device comprising:

an optical prism and having a front, optical face and first and second, inclined rear faces;

a first picture showing a first half of a person's face in a first position and a second picture, showing a complementary half of the person's face in a second position, sequentially different from the first position;

a picture frame surrounding the front face of the prism for mounting said first picture aligned behind said first rear face and said second picture aligned behind said second rear face, so that, when viewed through the front face at a first angle, a direct image of the first picture will be seen by direct transmission through the first rear face rear and front face and a mirror image of the first picture will be seen by direct transmission through the rear face, total internal reflection at the second rear face and subsequent transmission through the front lace so that direct and mirror images combine to provide an image, apparently of a whole person's face in the first position and, when viewed through the front face at a second angle, an image of the second picture will be seen by direct transmission through the rear and front faces and a mirror image of the second picture will be seen by transmission through the rear face, total internal reflection at the first rear face and subsequent transmission through the front face so that directly transmitted and mirror images of the complementary half of the object combine to provide a completed image, apparently of a whole person's face in the second position, whereby a spectator looking through the front face of the prism and rapidly switching between different angles sees apparently whole images of the person's face in the first position and in the second position alternatively, thereby providing an impression of animation by facial movement.

2. An amusement device according to claim 1 wherein the first picture and the second picture are on a single sheet and show respective half faces with respective axes of symmetry aligned with a central vertical axis dividing the sheet into left and right halves, respectively, the sheet being folded about the central vertical axis and located with left and right halves aligned, respectively, behind adjacent rear faces of the prism so that the central vertical axis is aligned with the intersection of the first and second rear faces of the prism.

3. A kit for making an amusement device providing an animated display of a person's photo comprising:

means for providing an optical prism having a front, optical face and first and second, inclined rear faces;

a first picture of a first half of a character's body in a first position and a second picture, of a complementary half of the character's body in a second position, sequentially different from the first position;

the first picture and the second picture defining adjacent areas on the respective character's body halves for mounting a photo of a person's face;

means for holding said first picture and a first half of said photo mounted thereon on the optical prism with a first half of the person's face aligned behind said first rear face and for holding said second picture and a second half of said photo mounted thereon showing a second half of the person's face aligned behind said second rear face, so that, when viewed through the front face at a first angle, a image of the first picture and first half of the person's face will be seen by direct transmission through the first rear face and the front face and a mirror image of the first picture and first half of the person's face will be seen by direct transmission through the first rear face, total internal reflection at the second rear face and subsequent transmission through the front face so that the direct and mirror images combine to provide a completed image, apparently of the character's whole body in the first position with apparently the person's whole face thereon and, when view d through the front face at a second angle, an image of the second picture and second half of the person's face will be seen by direct transmission through the second rear face and front face and a mirror image of the second picture and second half of the person's face will be seen by transmission through the second rear face, total internal reflection at the first rear face and subsequent transmission through the front face so that the direct and mirror images combine to provide a completed image apparently of the character's whole body in the second position with apparently the person's whole face thereon, whereby a spectator looking through the front face of the prism and rapidly switching between different angles sees apparently whole images of the character's body mounted with the persons face in the first position and in the second position alternatively, thereby providing an amusing impression of personalized animation.

4. A kit according to claim 3, wherein the first picture and the second picture are on a single sheet adjoining a central vertical axis dividing the sheet into left and right halves, respectively, and formed with a fold line for folding the sheet about the central vertical axis for location with left and right halves of the picture, and first and second halves of the person's face, aligned, respectively, behind adjacent rear faces of the prism so that the central vertical axis is aligned with the intersection of the first and second rear faces of the prism.

5. A kit according to claim 3, wherein the holding means comprises a picture frame surrounding the front face of the prism.

6. A kit according to claim 3, wherein the means for providing the optical prism comprises a clear walled prismatic shaped container for holding water forming the optical prism.

7. A kit according to claim 3, wherein said first and said second halves of the person's face have respectively different expressions.

8. An amusement device comprising:

an optical prism and having a front, optical face and first and second, inclined rear faces;

a first picture showing a first half of an object in a first position and a second picture, showing a complementary half of the object in a second position, sequentially different from the first position;

a picture frame surrounding the front face of the prism for mounting said first picture aligned behind said first rear ace and said second picture aligned behind said second rear face, so that, when viewed through the front face at a first angle, a direct image of the first picture will be seen by direct transmission through the first rear face rear and front face and a mirror image of the first picture will be seen by direct transmission through the rear face, total internal reflection at the second rear face and subsequent transmission through the front face so that direct and mirror images combine to provide an image, apparently of a whole object in the first position and, when viewed through the front face at a second angle, an image of the second picture will be seen by direct transmission through the rear and front faces and a mirror image of the second picture will be seen by transmission through the rear face, total internal reflection at the first rear face and subsequent transmission through the front face so that direly transmitted and and mirror images of the complementary half of the object combine to provide a completed image, apparently of a whole object in the second position, whereby a spectator looking through the front face of the prism and rapidly switching between different angles sees apparently whole images of the object in the first position and in the second position alternatively, thereby providing en impression animation by object movement.

9. An amusement device comprising:

an optical prism and having a front, optical face and first and second, inclined rear faces;

a first picture showing a first half of an object in a first position and a second picture, showing a complementary half of the object in a second position, sequentially different from the first position;

a picture frame surrounding the front face of the prism for mounting said first picture aligned behind said first rear face and said second picture aligned behind said second rear face, wherein the first picture and the second picture are on a single sheet and show respective half objects with respective axes of symmetry aligned with a central vertical axis dividing the sheet into left and right halves, respectively, the sheet being folded about the central vertical axis and located with left and fight halves aligned, respectively, behind adjacent rear faces of the prism so that the central vertical axis is aligned with the intersection of the first and second rear faces of the prism, so that, when viewed through the front face at a first angle, a direct image of the first picture will be seen by direct transmission through the first rear face rear and front face and a mirror image of the first picture will be seen by direct transmission through the rear face, total internal reflection at the second rear face and subsequent transmission through the front face so that direct and mirror images combine to provide an image, apparently of a whole object in the first position and, when viewed through the front face at a second angle, an image of the second picture will be seen by direct transmission through the rear and front faces and a mirror image of the second picture will be seen by transmission through the rear face, total internal reflection at the first rear face and subsequent transmission through the front face so that directly transmitted and and mirror images of the complementary half of the object combine to provide a completed image, apparently of a whole object in the second position, whereby a spectator looking through the front face of the prism and rapidly switching between different angles sees apparently whole images of the object in the first position and in the second position alternatively, thereby providing an impression animation by object movement.

10. A kit for making an amusement device providing an animated display of a person's photo comprising:

means for providing an optical prism having a front, optical face and first and second, inclined rear faces;

a first picture of a first half of a character's body in a first position and a second picture, of a complementary half of the character's body in a second position, sequentially different from the first position;

the first picture and the second picture defining adjacent areas on the respective character's body halves for mounting a photo of a person's face;

a picture frame surrounding the front face of the prism for holding said first picture and a first half of said photo mounted thereon on the optical prism with a first half of the person's face aligned behind said first rear face and for holding said second picture and a second half of said photo mounted thereon showing a second half of the person's face aligned behind said second rear face, so that, when viewed through the front face at a first angle, a image of the first picture and first half of the person's face will be seen by direct transmission through the first rear face and the front face and a mirror image of the first picture and first half of the person's face will be seen by direct transmission through the first rear face, total internal reflection at the second rear face and subsequent transmission through the front face so that the direct and mirror images combine to provide a completed image, apparently of the character's whole body in the first position with apparently the person's whole face thereon and, when viewed through the front face at a second angle, an image of the second picture and second half of the person's face will be seen by direct transmission through the second rear face and front face and a mirror image of the second picture and second half of the person's face will be seen by transmission through the second rear face, total internal reflection at the first rear face and subsequent transmission through the front face so that the direct and mirror images combine to provide a completed image apparently of the character's whole body in the second position with apparently the person's whole face thereon, whereby a spectator looking through a the front face of the prism and rapidly switching between different angles sees apparently whole images of the character's body mounted with the persons face in the first position and in the second position alternatively, thereby providing an amusing impression of personalized animation.

11. A kit for making en amusement device providing an animated display of a person's photo comprising:

a dear walled prismatic shaped container for holding water providing an optical prism having a front, optical face and first and second, inclined rear faces;

a first picture of a first half of a character's body in a first position and a second picture, of a complementary half of the character's body in a second position, sequentially different from the first position;

the first picture and the second picture defining adjacent areas on the respective character's body halves for mounting a photo of a person's face;

means for holding said first picture and a first half of said photo mounted thereon on the optical prism with a first half of the person's face aligned behind said first rear face and for holding said second picture and a second half of said photo mounted thereon showing a second half of the parson's face aligned behind said second rear face, so that, when viewed through the front face at a first angle, a image of the first picture and first half of the person's face will be seen by direct transmission through the first rear face and the front face and a mirror image of the first picture and first half of the person's face will be seen by direct transmission through the first rear face, total internal reflection at the second rear face and subsequent transmission through the front face so that the direct and mirror images combine to provide a completed image, apparently of the character's whole body in the first position with apparently the person's whole face thereon and, when viewed through the front face at a second angle, an image of the second picture and second half of the person's face will be seen by direct transmission through the second rear face and front face and a mirror image of the second picture and second half of the person's face will be seen by transmission through the second rear face, total internal reflection at the first rear face and subsequent transmission through the front face so that the direct and mirror images combine to provide a completed image apparently of the character's whole body in the second position with apparently the person's whole face thereon, whereby a spectator looking through a the front face of the prism and rapidly switching between different angles sees apparently whole images of the character's body mounted with the persons face in the first position and in the second position alternatively, thereby providing an amusing impression of personalized animation.

* * * * *